US012325555B2

(12) United States Patent
Henryk

(10) Patent No.: US 12,325,555 B2
(45) Date of Patent: Jun. 10, 2025

(54) TRANSPORT CONTAINER AND ASSEMBLY THEREOF

(71) Applicant: conTeyor International nv, Merelbeke (BE)

(72) Inventor: Wojtyla Henryk, Merelbeke (BE)

(73) Assignee: CONTEYOR INTERNATIONAL NV, Merelbeke (BE)

( * ) Notice: Subject to any disclaimer, the term of this patent is extended or adjusted under 35 U.S.C. 154(b) by 0 days.

(21) Appl. No.: 17/760,047

(22) PCT Filed: Feb. 10, 2021

(86) PCT No.: PCT/EP2021/053152
§ 371 (c)(1),
(2) Date: Aug. 3, 2022

(87) PCT Pub. No.: WO2021/160646
PCT Pub. Date: Aug. 19, 2021

(65) Prior Publication Data

US 2023/0058860 A1 Feb. 23, 2023

(30) Foreign Application Priority Data

Feb. 10, 2020 (BE) ..... 2020-5078

(51) Int. Cl.
*B65D 25/00* (2006.01)
*B65D 25/06* (2006.01)

(52) U.S. Cl.
CPC ..... *B65D 25/005* (2013.01); *B65D 25/06* (2013.01); *B65D 2313/02* (2013.01)

(58) Field of Classification Search
CPC .. B65D 25/005; B65D 2313/02; A47B 43/04; A47F 5/10; A47F 5/13
See application file for complete search history.

(56) References Cited

U.S. PATENT DOCUMENTS 5,560,507 A * 10/1996 Arpin ..... B65D 85/48 220/1.5
5,725,118 A 3/1998 Slager
(Continued)

FOREIGN PATENT DOCUMENTS

| | | | |
|---|---|---|---|
| DE | 19836204 | A1 | 2/2000 |
| EP | 1484253 | A1 | 12/2004 |
| WO | 2021/160646 | A1 | 8/2021 |

OTHER PUBLICATIONS

ISR/WO dated May 14, 2021 for parent application PCT/EP2021/053152.

*Primary Examiner* — Andrew T Kirsch
(74) *Attorney, Agent, or Firm* — Vorys, Sater, Seymour and Pease LLP

(57) ABSTRACT

The current invention relates to a transport container comprising a frame and a flexible compartment system suspended within said frame, wherein the frame has at least one open side, wherein the transport container has a cover that is movable between closed and open configurations for selectively covering and uncovering said open side, and wherein the frame is further provided with at least one elongate suspension member that extends along a side edge of said open side, and fitted through a sleeve formed by the compartment system. In particular, the cover extends in its closed configuration along said sleeve, contacting the sleeve. The invention further provides a method of assembling transport containers.

15 Claims, 6 Drawing Sheets

(56) References Cited

U.S. PATENT DOCUMENTS

| | | | | |
|---|---|---|---|---|
| 6,540,096 | B1 | 4/2003 | Bazany | |
| 8,998,011 | B2 | 4/2015 | Zhu | |
| 10,625,902 | B2 * | 4/2020 | Morcos | A45C 7/0036 |
| 2002/0144997 | A1 * | 10/2002 | Mendoza | D06F 95/002 220/9.2 |

* cited by examiner

TRANSPORT CONTAINER AND ASSEMBLY THEREOF

FIELD OF THE INVENTION

The invention pertains to flexible compartment systems for transport and storage of goods. In particular, the invention relates to transport containers that have a flexible compartment system suspended within a frame.

BACKGROUND

Transport and storage containers of this kind are generally well-known. Typically, the compartment system is kept taut within the frame. It provides compartments for accommodating goods during transport/storage.

As an example, EP 1 484 253 discloses a storage assembly that has a textile divider arrangement supported within a frame. The divider arrangement has a plurality of sleeves that are hung from frame bars. It provides a plurality of open-ended compartments. In addition, a front opening of the storage assembly is selectively closeable by means of a separate curtain. Latter curtain is suspended from the top of the frame. As a drawback, this curtain may not sufficiently seal off the compartments, from dust and other contaminants.

U.S. Pat. No. 8,998,011 discloses a collapsible rack that defines a receiving space. An inner fabric further divides said receiving space into a plurality of smaller compartments. A zipper is provided for covering the front opening. More particularly, the zipper is provided along an inward circumferential flap that limits the front opening size, and that may hamper insertion and extraction of goods.

U.S. Pat. No. 5,725,118 further discloses a container for holding product therein during shipment. The container body has at least one open side, providing access to a plurality of horizontal product bins inside. This open side may be covered. To such end, hook and loop fastening strips are provided to the other surface of the container body, and to the inner surface of a separate flexible wall structure. However, the provision of such fastening strips constitutes an additional step during assembly. The inventors further experienced that separate fastening strips provided to the outer surface of a container body may easily foul and/or come off. The design of U.S. Pat. No. 5,725,118 may therefore require more maintenance.

As an additional example, U.S. Pat. No. 6,540,096 discloses a collapsible shipping container. A front side of the container is normally open, but it can be covered by means of a transparent cover. One the one hand, latter cover is at its top edge riveted to an upper bar of the container body. Riveting, however, is cumbersome. The drilling of rivet holes may further present risks in terms of metal filings/shavings. On the other hand, the cover is at its bottom and side edges removably fastened by means of hook and loop fastening strips. These fastening strips connect to inward flanges provided on the container body. The above drawbacks in relation to separate fastenings trips are repeated. As an additional drawback, such inward flanges limit the front opening size, and they may hamper insertion and extraction of goods.

DE 198 36 204 discloses a container that is closed with a flexible curtain secured by its edges to the frame of the container by press fastening tapes.

Important characteristics of transport containers relate to ergonomics and ease of use. Transport containers should provide a maximally protected environment for the goods during loading, storage, transport, and/or unloading.

Preferably such transport containers are optimally assembled. Thus, with a limited number of assembly steps, a low complexity per step, and a minimum overall assembly time. A further focus is on durability and lifetime. Only limited maintenance should be required, or no maintenance at all. A further focus is on reusability and replaceability of parts, in particular of those parts that are subject to wear.

The present invention aims to provide a novel and improved transport device. It thereby tries to resolve at least some of the problems mentioned above.

SUMMARY OF THE INVENTION

To such end, the invention provides a transport container according to claim 1. The transport container comprises a frame and a flexible compartment system suspended within the frame. To such end, the frame is provided with at least one elongate suspension member that extends along a side edge of the container access opening, and that is fitted through a sleeve formed by the compartment system. In particular, the transport container further has a cover, which cover in its closed configuration extends along the sleeve, contacting the sleeve.

Quite advantageously, in its closed configuration, the cover connects directly to a sleeve that flanks the container access opening. In doing so, the cover may provide an effective barrier for dust and other contaminants.

Latter barrier will be more effective in case of intimate contact, or in case of some fastening mechanism provided to the cover and sleeve. Reference is made to the particularly preferred embodiment of claim 3.

Sleeves further provide a reliable way of suspending and possibly also stretching a compartment system within a frame. They also simplify the assembly. In a particular embodiment, suspension members that can be demounted from the frame may allow for easy disassembly and/or replacement of parts.

In a further preferred embodiment of claim 5, the cover and sleeve are provided with a hook and loop fastening mechanism. An outer surface of the sleeve has a loop fastening surface. This has the advantage of providing a generally soft surface edge region that surrounds the access opening. Thus lowering the risk of damaging goods during insertion/extraction.

In a further aspect, the invention provides a method of assembling transport containers, according to claim 14.

DETAILED DESCRIPTION OF THE INVENTION

Figure 1A:
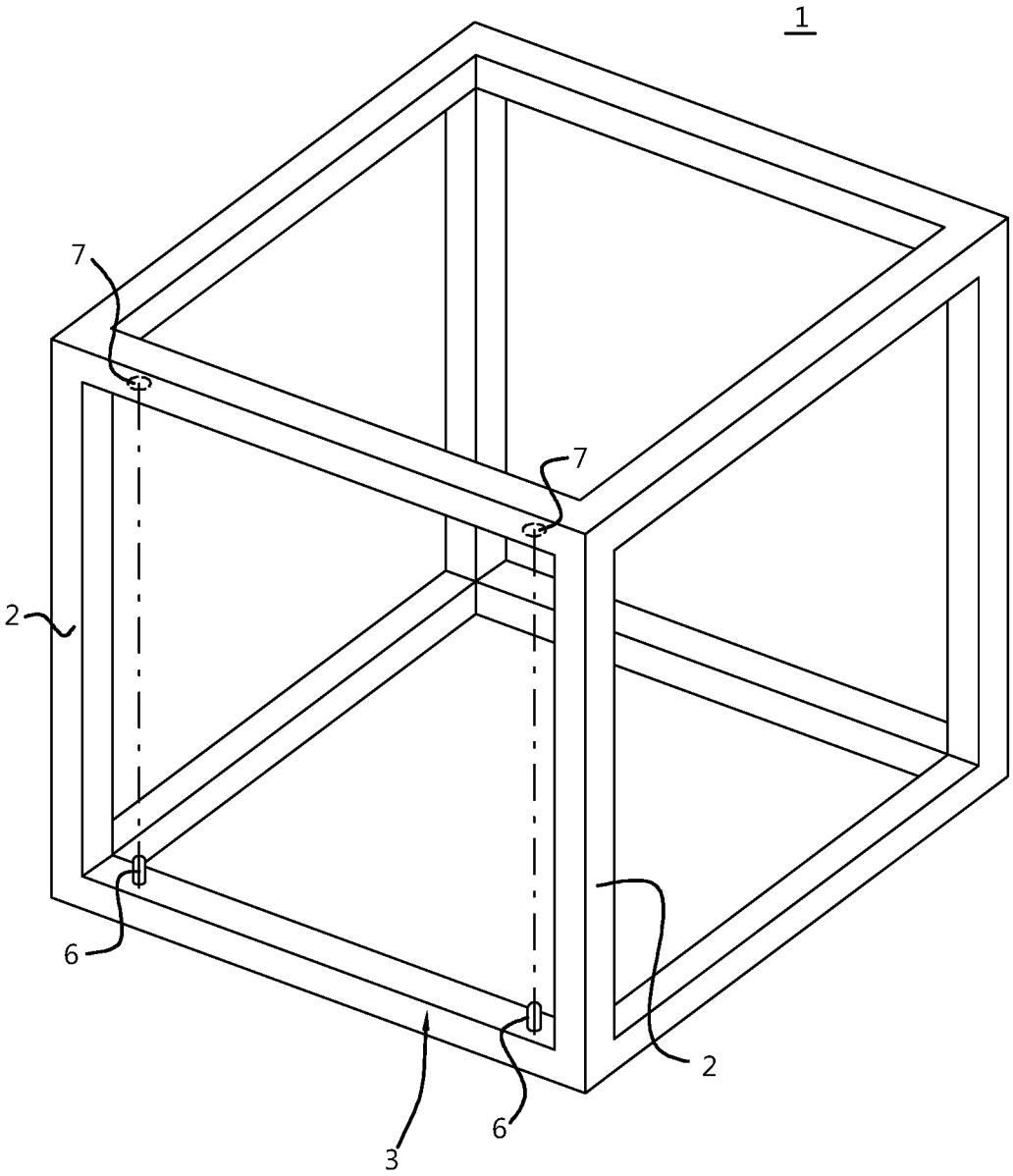
FIG. 1A depicts a transport container frame, according to a possible embodiment.

The present invention concerns a transport container, and a method for assembling transport containers.

Unless otherwise defined, all terms used in disclosing the invention, including technical and scientific terms, have the meaning as commonly understood by one of ordinary skill in the art to which this invention belongs. By means of further guidance, term definitions are included to better appreciate the teaching of the present invention.

As used herein, the following terms have the following meanings:

"A", "an", and "the" as used herein refers to both singular and plural referents unless the context clearly dictates otherwise. By way of example, "a compartment" refers to one or more than one compartment.

"About" as used herein referring to a measurable value such as a parameter, an amount, a temporal duration, and the like, is meant to encompass variations of +/−20% or less, preferably +/−10% or less, more preferably +/−5% or less, even more preferably +/−1% or less, and still more preferably +/−0.1% or less of and from the specified value, in so far such variations are appropriate to perform in the disclosed invention. However, it is to be understood that the value to which the modifier "about" refers is itself also specifically disclosed.

"Comprise", "comprising", and "comprises" and "comprised of" as used herein are synonymous with "include", "including", "includes" or "contain", "containing", "contains" and are inclusive or open-ended terms that specifies the presence of what follows e.g. component and do not exclude or preclude the presence of additional, non-recited components, features, element, members, steps, known in the art or disclosed therein.

The recitation of numerical ranges by endpoints includes all numbers and fractions subsumed within that range, as well as the recited endpoints.

The expression "% by weight", "weight percent", "% wt." or "wt. %", here and throughout the description unless otherwise defined, refers to the relative weight of the respective component based on the overall weight of the formulation.

In a first aspect, the invention relates to a transport container comprising a frame and a flexible compartment system suspended within said frame, wherein the frame has at least one open side, wherein the compartment system provides one or more compartments accessible via said open side, and wherein the transport container further has a cover that is movable between closed and open configurations for selectively covering and uncovering said open side, wherein the frame is further provided with at least one elongate suspension member that extends along a side edge of said open side, and is fitted through a sleeve formed by the compartment system. In particular, in its closed configuration, the cover extends along said sleeve, thereby contacting/abutting said sleeve.

"Container", as used herein, is generally understood as a device for storing or transporting goods. The transport container according to the invention may or may not comprise a generally cuboid frame having an upper side, a lower side and four lateral sides. One or more of these sides may be provided with corresponding side walls. Alternatively, the transport container may have a generally open frame. In any case, at least one of the transport container sides is open. That means, it may provide access to the container interior. Said open side may be a lateral side of the transport container. Alternatively, said open side may be an upper side of the transport container. The transport container and/or the container frame may be collapsible/foldable.

A compartment system is further suspended within the frame. Latter compartment system defines at least one compartment that is suitable for receiving goods. More preferably, the compartment system defines a plurality of such compartments, e.g. constituting a rectangular grid. These compartments can be accessed from an access opening at the open side of the container. Frame edges surrounding said open side may correspond to the access opening edges.

In a possible embodiment, the container has an open front side. The compartment system further defines a plurality of compartments that are generally horizontally disposed, and that can be accessed from an access opening at the front.

The compartment system may be (partly) flexible. The compartment system may comprise a flexible material. In a possible embodiment, the compartment system may comprise one or more sheets of a strip material that is confectioned (e.g. via sewing, gluing, or otherwise) into a flexible compartment system that has one or more compartments. The strip material may comprise one or more layers. The strip material may comprise a knitted layer. This has the advantage of being soft, dust absorbent, inexpensive, and less likely to be damaged by goods that have sharp edges. The strip material may comprise three layers that form a laminated product, e.g. via a glue such as a polyurethane glue. In a possible embodiment, The strip material may comprise a knitted fabric lower layer, a weave fabric middle layer, and a knitted fabric upper layer. Such strip materials are particularly lightweight, strong, and durable.

The compartment system comprises at least one loop or sleeve. In addition to the above, latter sleeve may be integrally formed by one of the strip material sheets. Alternatively, latter sleeve comprises a separate fabric sheet that is connected to the compartment system, e.g. via gluing and/or sewing. However, the invention in general is not limited hereby. The sleeve is fitted over a suspension member provided on the container frame. This may contribute to suspending the compartment system within the frame. More specifically, this may contribute to keeping the (flexible) compartment system taut within the frame, e.g. when tensioning the compartment system between one or more of such suspension members, via corresponding sleeves.

Preferably, the suspension member can be mounted to, and demounted from (the remainder of) the frame. This allows for straightforward assembly and disassembly, and for easy replacement of e.g. the compartment system. The suspension member may be a tube, a rod, or a profile. The invention is generally not limited to any of these. The suspension member may have opposite end portions. Such end portions may be mounted to opposite side edges of the frame. Alternatively, such end portions may be mounted to opposite end portions of the same frame side edge.

As stated above, the suspension member preferably extends along a side edge of the open side of the frame. Preferably, it is parallel to latter side edge. Preferably, it is positioned between said side edge and the compartment system access opening.

In a possible embodiment, the frame has an open lateral side. It has two upright suspension members that extend along opposite side edges of said lateral side, flanking the access opening. Corresponding sleeves are fitted over the suspension members. This way, the access opening of the compartment system is kept taut, between the suspension members.

An advantage of sleeves that are stitched to, or otherwise formed by the compartment system is that they provide a reliable suspension means. Indeed, tension applied on the sleeves is distributed along the length of the sleeves. Possible assembly and/or disassembly, via elongate suspension members fitted into the sleeves is straightforward.

The transport container additionally has a movable cover. Latter cover can be moved between a closed configuration (in which the cover covers the access opening), and an open configuration (in which the access opening is not covered by the cover). The cover may include a cover panel or a cover tarp. The cover may have at least one edge portion that normally stays connected to the frame and/or to the compartment system. Most importantly, in its closed configuration, part of the cover connects directly to at least one sleeve that flanks the access opening. In doing so, the cover may provide an effective barrier for dust and other contaminants. In particular, said barrier will be more effective in case of intimate contact between the cover and sleeve, and/or in case of the cover being fastened to the sleeve (see below). The barrier/seal will exist along the length of the cover-sleeve contacting portion. Therefore, the sleeve preferably extends over substantially the entire length of the access opening edge.

In a further or alternative embodiment, the cover in its closed configuration overlays the suspension member and sleeve. The suspension members may thus provide a rigid support, against which the cover can be efficiently closed.

In a further or alternative embodiment, the cover and/or the sleeve are provided with a releasable fastening mechanism for fastening said cover to said sleeve, in the closed configuration. This advantageously ensures that the cover remains in its closed configuration, at least partly sealing off the access opening. Moreover, the fastening mechanism can be integrated directly into the cover and/or sleeve. No additional steps are required during the assembly of the compartment system within the container frame. Since the fastening mechanism is part of the cover and sleeves, it does not further obstruct the access opening in any way.

Suitable fastening mechanisms may include magnetism, electrostatics, surface adhesion, mechanics (e.g. zippers, hook and loop fasteners, buttons) and/or any combination thereof. The invention is generally not limited to any of these.

In a further or alternative embodiment, the cover and sleeve are provided with a hook and loop fastening mechanism. In a further or alternative embodiment, an outer surface of the sleeve is provided with a loop fastening surface. This has the advantage of providing a generally soft surface edge region that surrounds the insertion opening. In a further or alternative embodiment, the sleeve is formed by a loop fastening fabric. Reference is made to the non-limiting embodiment of FIG. 4B.

In a further or alternative embodiment, one or more suspension members have a rounded cross-sectional profile. Especially for a suspension member that is provided next to the access opening, a rounded profile poses lower risk on damaging goods during insertion/extraction. The rounded profile may comprise a circular profile, an oval profile, a circle sector profile, or a rounded square profile. But it is not limited to any of these.

In a further or alternative embodiment, the suspension member is releasably fitted over a frame pin and/or into a frame hole. Especially in case such holes and pins are provided in advance, the assembly of the compartment system within the frame requires no further precision.

In a further or alternative embodiment, the frame is provided with:

- a lower suspension member having an end portion featuring a mounting hole, by which said member is fitted over a frame pin, and
- an upright suspension member having an end portion fitted over said same frame pin, thereby locking said lower suspension member end portion in place.

This provides a particularly effective assembly. The step of providing the upright suspension member automatically locks the lower suspension member into place. More preferably, the lower suspension member has two such end portions that are locked in place via upright suspension members at corresponding left and right sides with respect to the container opening.

In a second aspect, the invention relates to a method of assembling a transport container, which method comprises the step of suspending a flexible compartment system within a frame, wherein the frame is provided with one or more elongate suspension members that are fitted through corresponding sleeves of the flexible compartment system, and wherein the storage container is further provided with a movable cover for covering and uncovering an open side thereof, in a respective closed and open configuration. In particular, said cover in its closed configuration extends along at least one of said sleeves, while contacting said sleeves.

Optionally, said method is suited for assembling the transport container described above. The same characteristics and corresponding advantages may therefore apply. For instance, opposite end portions of at least one suspension member may be fitted over frame pins and/or frame holes, for efficiently mounting said suspension member into the frame.

The invention is now further described by means of the following examples and figures which further illustrate the invention, and are not intended to, nor should they be interpreted to, limit the scope of the invention.

FIG. 1A depicts a transport container frame 1 according to a possible embodiment of the invention. The frame 1 is generally cuboid. It has twelve edges 2 and six (open) sides 3. In particular, the frame 1 is adapted for receiving a flexible compartment system 4 therein. For instance, the compartment system 4 of FIG. 1B may qualify.

Figure 2:
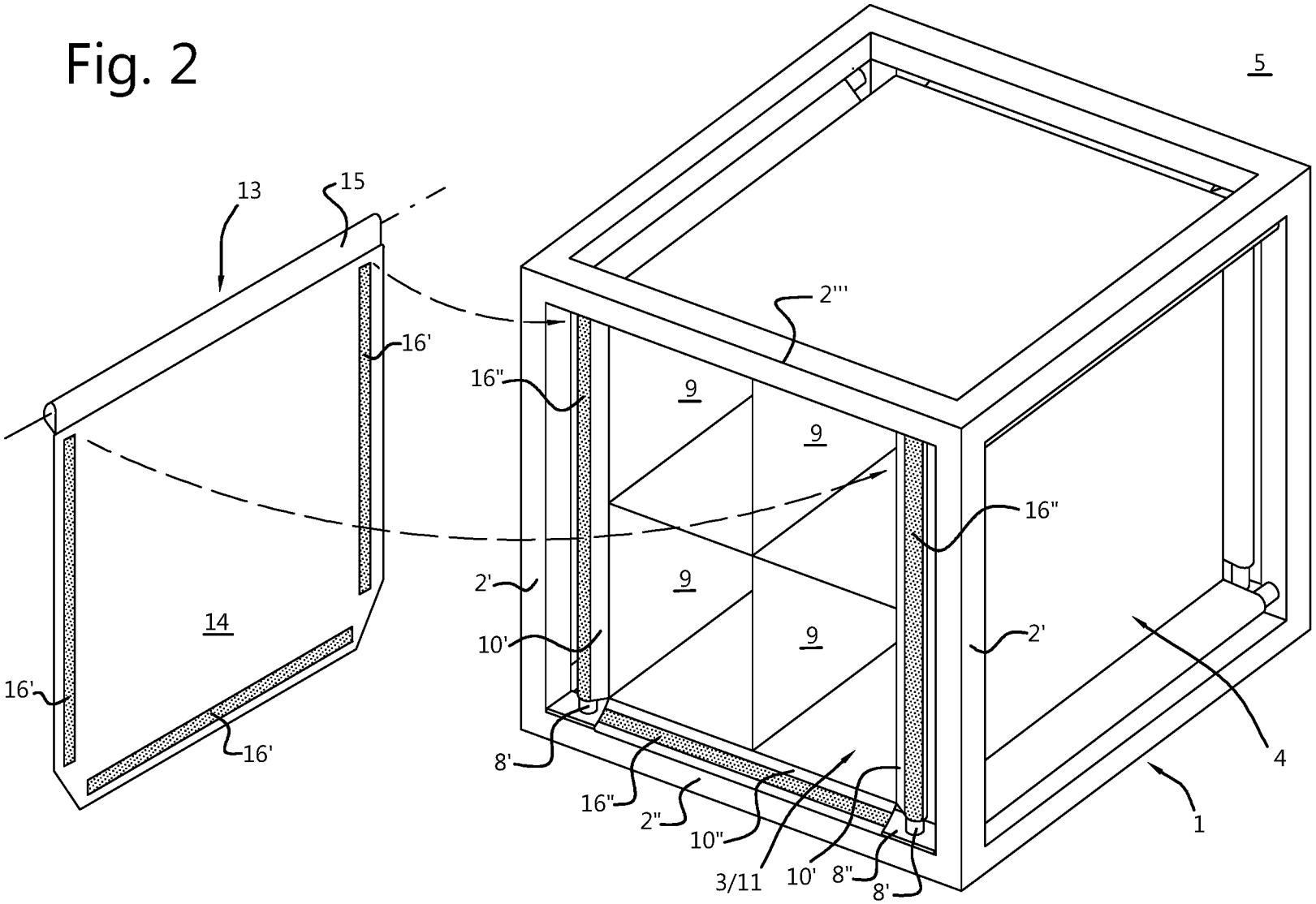
FIG. 2 further depicts a transport container, according to a possible embodiment.
Figure 3:
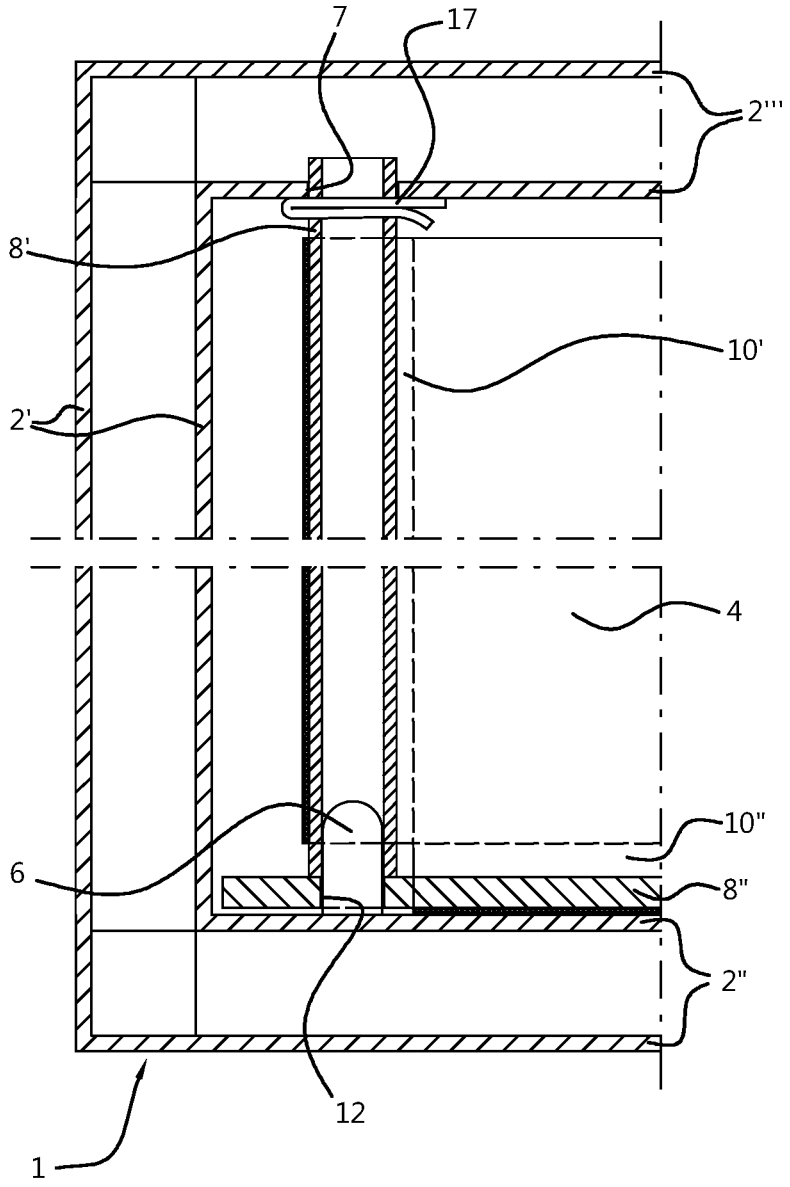
FIG. 3 illustrates a mechanism for suspending a compartment system within a frame, according to a possible embodiment.

The container frame 1 has frame pins 6 and opposing frame holes 7. These will allow for straightforward suspension of the compartment system 4 within the frame 1, by means of dedicated suspension members 8', 8". Reference is made to FIG. 2-3. Only two such frame pins 6 and frame holes 7 are depicted in FIG. 1A (for reasons of simplicity), at the front side opening 3 of the frame 1.

Figure 1B:
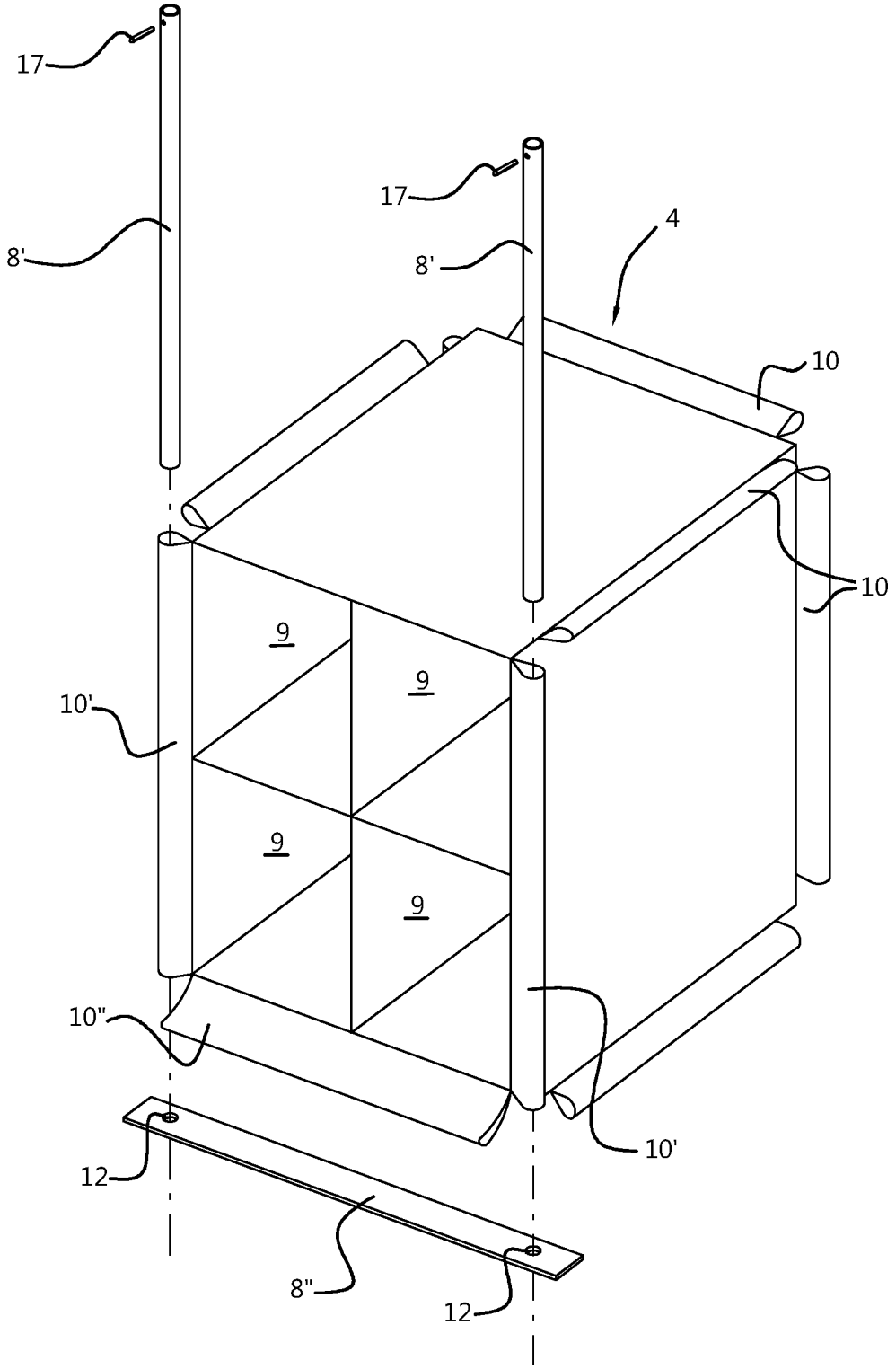
FIG. 1B depicts a compartment system, according to a possible embodiment.

FIG. 1B depicts a flexible compartment system 4 according to a possible embodiment of the invention. It provides four compartments 9 for storing goods during transport. The compartment system 4 further has multiple sleeves 10', 10". Elongate suspension members 8', 8" can be fitted through these sleeves 10', 10", and subsequently mounted to the frame 1. In doing so, the compartment system 4 is suspended within the frame 1. The aforementioned frame pins 6 and frame holes 7 of FIG. 1A allow for a particularly straightforward and effective assembly, also illustrated in FIG. 2-3.

FIG. 2 further depicts a transport container 5 comprising the container frame 1 of FIG. 1A, and further comprising the flexible compartment system 4 of FIG. 1B. The container frame 1 has an open front side 3. Its compartments 9 can be accessed via the latter. Also at said open front side 3, the frame 1 is provided with two upright suspension members 8' and one lower suspension member 8". These suspension members 8', 8" are fitted through corresponding sleeves 10', 10" formed by the compartment system 4, and mounted to the container frame 1. The upright suspension members 8' extend along opposite vertical side edges 2' of the open front side 3. The lower suspension member 8" extends along a lower horizontal edge 2" of said open front side 3. Each suspension member 8', 8" has one corresponding sleeve 10', 10". And the length of each sleeve 10', 10" generally corresponds to the length of the corresponding side opening edge/frame edge 2', 2". These suspension members 8', 8" and sleeves 10', 10" contribute to keeping the front opening 11 of the compartment system 4 taut, within the open front side 3 of the container frame 1.

The transport container 5 further has a cover 13 for selectively covering and uncovering the open front side 3 of the container 5. The cover 13 may comprise a cover tarp 14. In FIG. 2, the cover 13 is depicted separately from the container frame 1 and the compartment system 5. In assembled state, the cover tarp 14 may be suspended from an upper bar 15 that is mounted along an upper edge 2'" of the container frame 1. Alternatively, the cover tarp 14 has an upper edge that is directly connected to the flexible compartment system 4 (e.g. via stitching). The invention is not limited to any of these.

In any case, the cover 13 has two configurations. It has a first, open configuration in which the cover tarp 14 is not covering the front opening 11 of the compartment system 4. It also has a second, closed configuration in which the cover tarp 14 does cover the front opening 11. Preferably, in its closed configuration, the cover tarp 14 extends over and along the sleeves 10', 10", thereby abutting the sleeves 10', 10". The cover 13 thus provides a barrier to dust and other contaminants. The cover 13 may or may not overlay the corresponding suspension members 8', 8". Preferably, the cover 13 and/or the sleeves 10', 10" are provided with some kind of fastening mechanism (e.g. respective hook and loop type fastening strips 16) for releasably fastening the cover 13 to the sleeves 10', 10" in this closed configuration.

FIG. 3 illustrates in cross-section a possible mechanism for suspending the compartment system 4 within the frame 1, according to a possible embodiment. The suspension mechanism relies on the frame pins 6 and frame holes 7 discussed earlier, and co-acting with the suspension members 8', 8".

In a possible (non-limiting) embodiment, the suspension members 8', 8" are first fitted through the sleeves 10', 10" formed by the compartment system 4. The lower suspension member 8" has opposite end portions provided with mounting holes 12 (shown in FIG. 1B and FIG. 3). These mounting holes 12 are now fitted over corresponding frame pins 6 provided by the container frame 1. Thereafter, upper end portions of the upright suspension members 8' are inserted into frame holes 7 that oppose the aforementioned frame pins 6. The upright suspension members 8' are raised within these frame holes 7, up to the point where their lower end portions (which are hollow) can be lowered over the frame pins 6. In a last step, the upright suspension members 8 are secured. Suitable securing means 17 may include cotter pins. Quite advantageously, the upright suspension members 8' also lock the lower suspension member 8" in place. When removing the cotter pins, the suspension members 8', 8" may be removed from the frame 1. This enables straightforward disassembly.

Figure 4A:
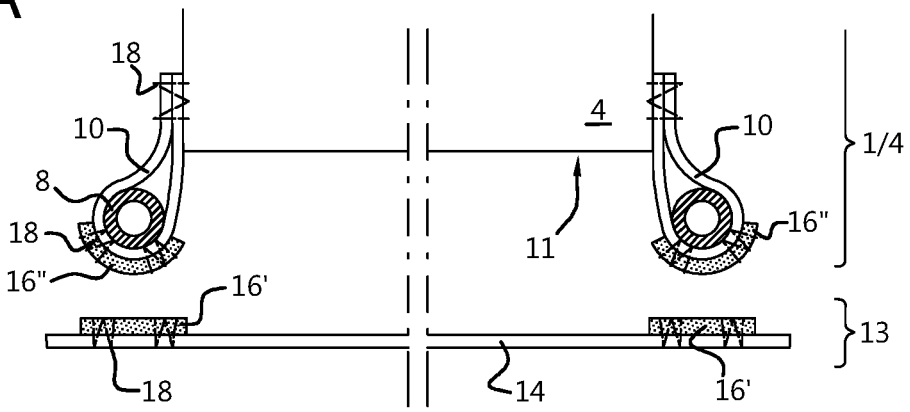
FIGS. 4A-C schematically illustrate a number of releasable fastening mechanisms for the cover, according to possible embodiments of the invention.
Figure 4B:
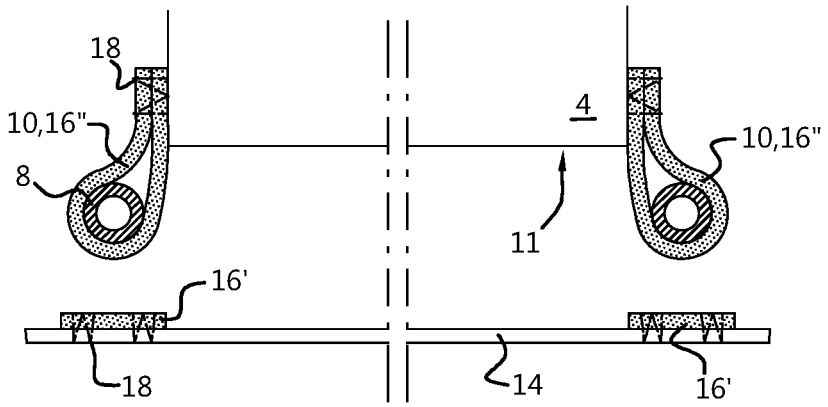
Figure 4C:
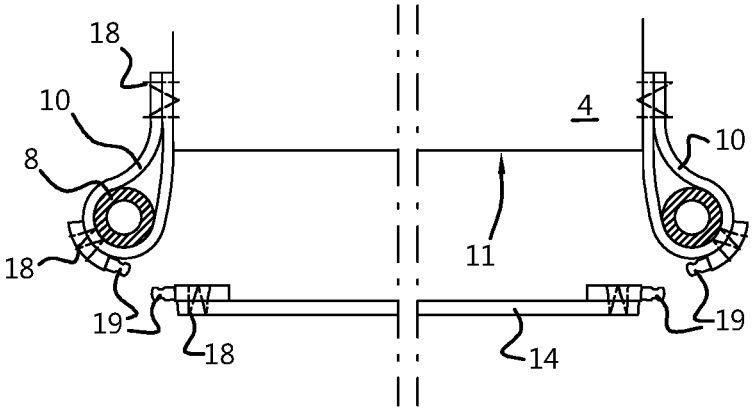

FIGS. 4A-C schematically illustrate a number of releasable fastening mechanisms for the cover 13. Horizontal cross-sections are depicted. In all three embodiments, the compartment system 4 has left and right sleeves 10. These sleeves 10 flank the access opening 11 of the container 5. They may e.g. be stitched to the fabric of the compartment system 4. They are fitted over dedicated suspension members 8, for the purpose of suspending the compartment system 4 within the frame 1. In each of the embodiments, the cover 13 is depicted separately from the compartment system 4 and frame 1. Releasable fastening mechanisms 16, 19 are provided for fastening the cover 13 to the sleeves 10.

In FIG. 4A-B, the cover is provided with hook fastening strips 16', and the sleeves 10 are provided with corresponding loop fastening surfaces 16". More specifically, in FIG. 4A the sleeves 10 have a loop fastening strip 16" stitched onto their outer surface. In FIG. 4B, by contrast, the sleeves 10 are formed by a loop fastening fabric 16" that is bent into a loop, and stitched to compartment system 10. Quite advantageously, in such designs, the access opening 11 is adjoined by loop fastening surfaces 16". Such surfaces 16" (especially those made from synthetic materials such as nylon or polyester) tend to be very soft. This provision thus lowers the risk of damaging or scratching goods, upon insertion into/extraction from the compartment system 4. Preferably, as can be seen throughout the embodiments of FIG. 4A-C, the suspension member 8 has a rounded design. Again, the risk of damaging goods is lower.

The embodiment of FIG. 4C provides an alternate fastening mechanism 19 for the cover 13. The cover 13 and sleeves 10 are provided with corresponding zipper fastening means 19. For instance, such zippers 19 are provided via stitches 18. The cover 13 may comprise a stretch fabric that stretches towards the sleeves 10, upon closing the zippers 19.

The "closed configurations" that correspond to these embodiments are readily obtained, by approaching the fastening means 16, 19 towards each other. In FIG. 4C, this may involve some outward stretching of the cover 13. In its closed configuration, the cover 13 (of FIG. 4A-C) extends along both sleeves 10, contacting/abutting the sleeves 10. As such, the cover 13 provides an effective barrier for dust and other contaminants. Moreover, the cover 13 will thereby overlay/cover (at least a portion of) the sleeves 10 and suspension members 8 behind. Advantageously, the rigid suspension members 8 provide a sturdy support for closing and fastening the cover 13. Also, and in contrast to some of the prior art designs, this fastening mechanism 16, 19 does not hinder the insertion and extraction of goods (in the open configuration).

Figure 5A:
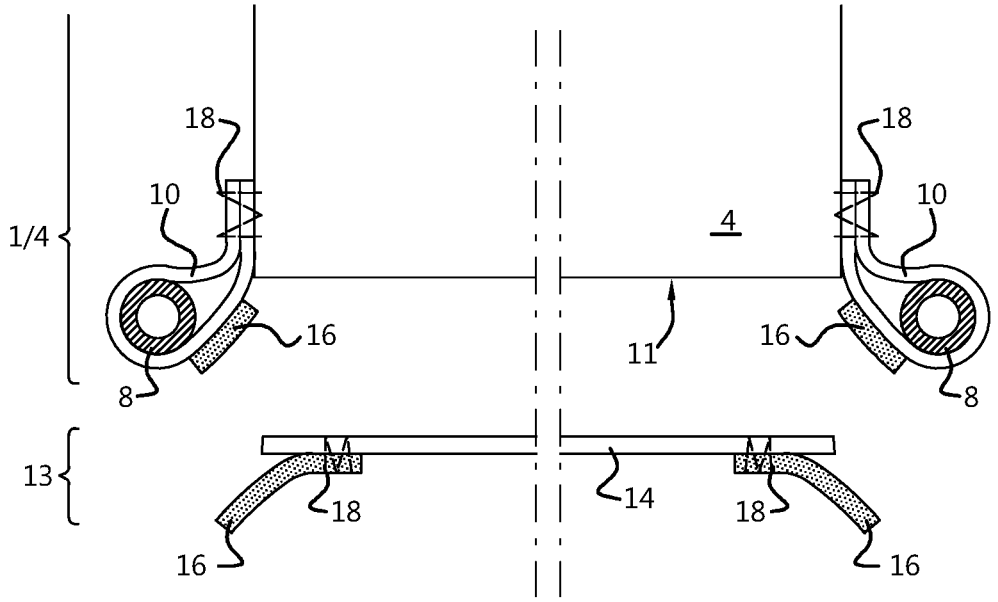
FIGS. 5A-B schematically illustrate an alternative embodiment of the transport container.
Figure 5B:
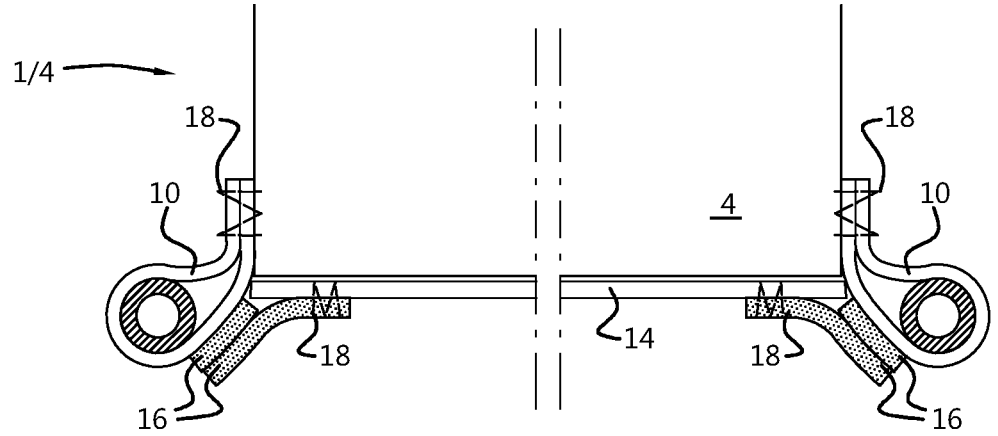

FIGS. 5A-B schematically illustrate an alternative embodiment of the transport container 5, again in cross-section. Its compartment system 4 has two opposite sleeves 10. These are fitted over suspension members 8, mounted into the frame 1. The transport container 5 further includes a cover 3. In FIG. 5A, the cover 13 is shown in open configuration. In FIG. 5B, the cover 13 is shown in closed configuration.

The sleeves 10 and the cover 13 are provided with corresponding fastening strips 16. For instance such fastening strips 16 are glued to an outer surface of the sleeves 10, and stitched along the edges of the cover 13, respectively. In the closed configuration of FIG. 5B, the fastening strips 16 of the cover 13 overlay a portion of the sleeves 10. Latter sleeve portion are provided with further strips 16 that engage the former, and establish some releasable fastening mechanism. Their engagement may be magnetically, mechanically, electrostatically, adhesively, chemically, or in any other way.

The numbered elements on the figures are:

1 Frame
2 Edge
3 Open side (of the frame)
4 Compartment system
5 Transport container
6 Frame pin
7 Frame hole
8 Suspension member
9 Compartment
10 Sleeve
11 Opening (of the compartment system)
12 Mounting hole
13 Cover
14 Cover tarp
15 Upper bar
16 Fastening means
16' Hook type fastening means
16" Loop type fastening means
17 Securing means
18 Stitches
19 Zipper fastening means The present invention is in no way limited to the embodiments described in the examples and/or shown in the figures.

The invention claimed is:

1. A transport container comprising a frame of a generally cuboid shape formed of side edges surrounding each side of the frame and a flexible compartment system laterally offset from and suspended within and from said frame, wherein the frame has at least one open side, wherein the compartment system provides one or more compartments accessible via said open side, and wherein the transport container further has a cover that is movable between closed and open configurations for selectively covering and uncovering said open side, wherein the frame is further provided with at least one elongate suspension member mounted to the frame and that extends along at least one side edge of said open side and is laterally offset from the at least one side edge towards a center of the open side, and that is fitted through a sleeve formed by the compartment system, characterized in that the cover in its closed configuration extends over and along said sleeve, contacting the sleeve.

2. The transport container of claim 1, wherein said cover in its closed configuration overlays said suspension member and said sleeve.

3. The transport container according to claim 1, wherein the cover and/or the sleeve are provided with a releasable fastening mechanism for fastening said cover to said sleeve, in the closed configuration.

4. The transport container according to claim 1, wherein the cover and the sleeve are provided with a hook and loop type fastening mechanism.

5. The transport container of claim 4, wherein an outer surface of the sleeve is provided with a loop fastening surface.

6. The transport container according to claim 4, wherein said sleeve is formed by a loop fastening fabric.

7. The Transport container according to claim 1, wherein said suspension member has a rounded cross-sectional profile.

8. The transport container according to claim 1, wherein said sleeve extends over substantially the entire length of the at least one side edge.

9. The transport container according to claim 1, wherein said suspension member is releasably mounted to the frame.

10. The transport container of claim 9, wherein said suspension member is releasably fitted over a frame pin and/or into a frame hole.

11. The transport container according to claim 1, wherein said frame is provided with:

a lower suspension member having an end portion featuring a mounting hole, by which said member is fitted over a frame pin, and an upright suspension member having an end portion fitted over said same frame pin, thereby locking said lower suspension member end portion in place.

12. The transport container according to claim 1, wherein said frame is provided with two suspension members along opposite side edges of said open side, and fitted through opposite sleeves formed by the compartment system.

13. The transport container according to claim 1, wherein said cover comprises a cover panel and/or a cover tarp.

14. A method of assembling a transport container, which method comprises the step of suspending a flexible compartment system within and from a frame of a generally cuboid shape formed of side edges surrounding each side of the frame, wherein the frame is provided with one or more elongate suspension members mounted to an open side of the frame, and laterally offset from at least one side edge towards a center of the open side, that are fitted through corresponding sleeves of the flexible compartment system, and wherein the storage container is further provided with a movable cover for covering and uncovering an open side thereof, in a respective closed and open configuration, characterized in that said cover in its closed configuration extends over and along at least one of said sleeves, while contacting said sleeves.

15. The method of claim 14, wherein opposite end portions of at least one suspension member are removably fitted over frame pins and/or into frame holes.

* * * * *